US005311254A

United States Patent [19]

Watanabe

[11] Patent Number: 5,311,254

[45] Date of Patent: May 10, 1994

[54] IMAGE FORMING APPARATUS HAVING A PAPER JAM DETECTING SYSTEM FOR THE AUTOMATIC DOCUMENT HANDLER

[75] Inventor: Hiroshi Watanabe, Yokohama, Japan

[73] Assignee: Kabushiki Kaisha Toshiba, Kawasaki, Japan

[21] Appl. No.: 929,522

[22] Filed: Aug. 14, 1992

[30] Foreign Application Priority Data

Sep. 30, 1991 [JP] Japan ..... 3-252165

[51] Int. Cl.[5] ..... G03G 21/00

[52] U.S. Cl. ..... 355/206; 271/259; 355/316

[58] Field of Search ..... 355/205, 206, 316, 320, 355/308, 309; 271/256, 258, 259

[56] References Cited

U.S. PATENT DOCUMENTS 4,786,041 11/1988 Acquaviva et al. ..... 355/206 X
4,816,865 3/1989 Hamano ..... 355/206
5,010,364 4/1991 Maekawa et al. ..... 355/308 X
5,081,490 1/1992 Wakao ..... 271/258 X

FOREIGN PATENT DOCUMENTS 57-35878 2/1982 Japan .

*Primary Examiner*—Benjamin R. Fuller
*Assistant Examiner*—J. E. Barlow, Jr.
*Attorney, Agent, or Firm*—Foley & Lardner

[57] ABSTRACT

In an image forming apparatus according to the present invention, when a resist sensor detects an error or a malfunction in the forward feeding of the document, a main processor continues the copying operation for the document until a preset number of copies for the document are completed. After the completion of copying, the error is corrected and then the document is discharged. The image forming apparatus is simple in operation, and enables the correct number of copies to be made without complicated control.

11 Claims, 5 Drawing Sheets

IMAGE FORMING APPARATUS HAVING A PAPER JAM DETECTING SYSTEM FOR THE AUTOMATIC DOCUMENT HANDLER

BACKGROUND OF THE INVENTION

1.Field of the Invention

The present invention relates to an automatic document carrying device and, more particularly, to an image forming apparatus such as a copying machine having an automatic document carrying device.

2. Description of the Related Art

In a conventional copying machine, when a jam is detected by an automatic document carrying device, a copying unit is not supplied with a signal indicating where the jam occurs. Even though the jam is made at the intermediate position (which is referred to as a document forward-feeding position) between a paper feeding unit and an image forming position, the copying unit cannot detect whether the jam is a jam in document forward-feeding. Therefore, the copying unit interrupts its copying operation, regardless of where the jam occurs. More specifically, when a plurality of copies is made, the a copying operation is stopped before all of the copies are completed, and the remaining number of copies is stored in the copying unit. Then, the document is reset and the copying operation is restarted for the remaining number of copies.

When the jam in document forward-feeding occurs, the jammed document does not reach an exposure position (image forming position) and, thus, exercises no influence on a copy of another document at the exposure position. Nevertheless, a conventional copying machine stops its copying operation immediately and is, thus, inferior in operation. Further, since the copying operation is stopped before all the copies are competed, the copying unit has to store information indicating whether the remaining copies should be made or not, and a precise number of copies cannot be made unless the error in document forward-feeding is correctly handled.

SUMMARY OF THE INVENTION

It is accordingly an object of the present invention to provide an image forming apparatus capable of making a correct number of copies in a simple operation, without complicated controls, in which a preset number of copies of a document at an image reading position continues unless a malfunction in feeding of a document affects image formation of the document at the image reading position.

More specifically, an object of the present invention is to provide an image forming apparatus capable of making a correct number of copies in a simple operation, without complicated controls, in which an operation for a preset number of copies of a document is not stopped even when a malfunction in document forward-feeding occurs.

To attain the above object, the image forming apparatus according to the present invention comprises:

means for carrying a document to an image reading position and discharging the document from the image reading position;

means for detecting a carrying malfunction in the document carried by the carrying means;

means for reading an image of the document at the image reading position;

means for forming the image read by said reading means on a preset number of image forming mediums; and control means for stopping said image forming means from forming an image after the image is formed on all of the preset number of image forming mediums by the image forming means, if said detecting means detects a carrying malfunction in a document other than the carrying malfunction in the document at the image reading position while the forming means is forming the image.

In the image forming apparatus according to the present invention, when a carrying malfunction in a document is detected, an image forming operation (copying operation) is not interrupted, but a document at the image reading position is discharged by the carrying means when an image of the document at the image reading position is formed on all the preset number of image forming mediums, such as copying paper. Then the carrying malfunction in the document is released and an image forming operation is restarted for the next document.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of the present invention will now be described, with reference to the accompanying drawings.

Figure 1:
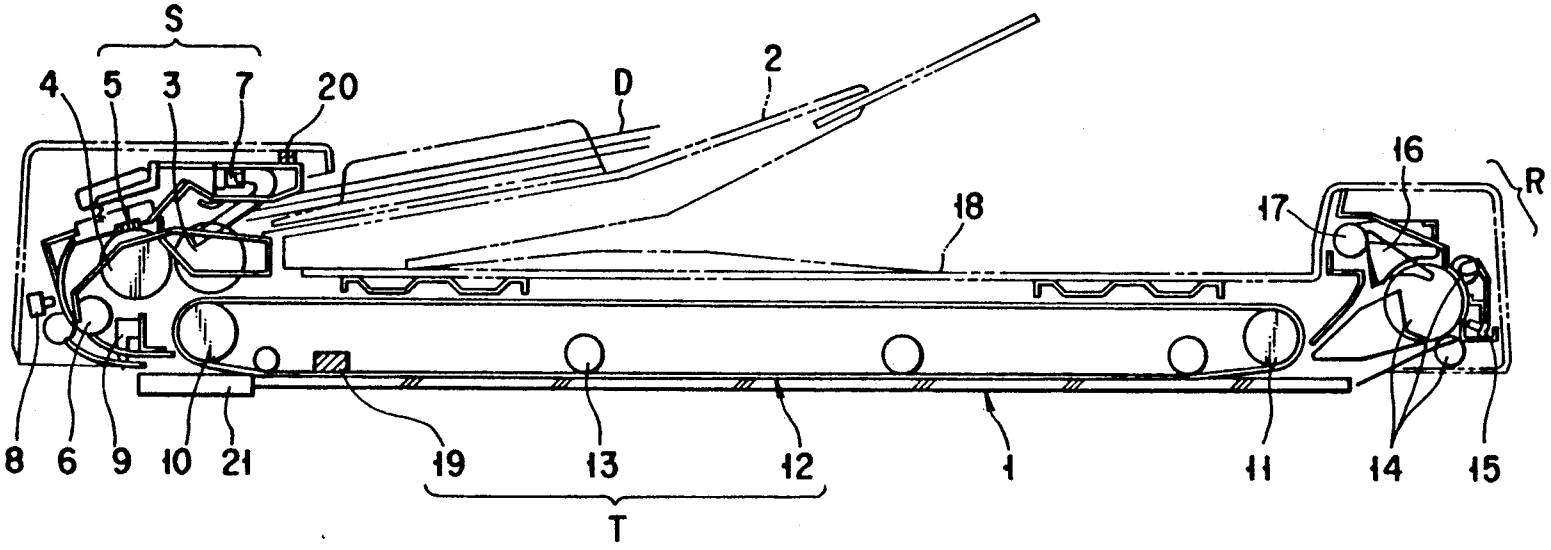
FIG. 1 is a schematic view showing a document carrying device.

FIG. 1 schematically shows a constitution of an automatic document carrying device mounted on an electronic copying machine.

The automatic document carrying device comprises a supply unit S, a carrying unit T, and a reverse/ discharge unit R. The supply unit S sequentially supplies documents D one by one. The carrying unit T carries the documents D onto a document table 1, that is, to an exposure position (image reading position) of the electronic copying machine, and carries the documents D from the table 1 to the reverse/discharge unit R after they are exposed by the electronic copying machine.

The reverse/discharge unit R reverses or discharges the documents D selectivity. The document carrying device, which is foldable or can be opened and closed, serves as a cover for the table 1.

The supply unit S includes a document feeding tray 2 in which the documents D are set in a pile, a pick-up roller 3 for picking up the documents D set in the document feeding tray 2 one by one, a separation roller 4 for sending out the documents D picked up by the pick-up roller 3, a separation pad 5 contacting the separation roller 4, and an aligning roller pair 6 for aligning and carrying the documents D sent out by the separation roller 4. Furthermore, an empty sensor 7 for detecting the presence or absence of the documents D is arranged near the document feeding tray 2, a resist sensor 8 is arranged before the aligning roller pair 6 in the document feeding direction, and a size sensor 9 for detecting the sizes of the documents D is arranged after the aligning roller pair 6 in this direction.

The carrying unit T includes an endless carrying belt 12 driven by belt rollers 10 and 11, for carrying the documents D along the table 1, and a belt press roller 13 for pressing the carrying belt 12 against the table 1.

The reverse/discharge unit R includes a reverse roller group 14 for receiving the documents D carried by the carrying unit S, and turning them upside down and guiding them to the carrying unit S, and a discharge roller 17 for guiding the documents D to a discharge tray 18. A discharge sensor 15 is arranged in the reverse roller group 14. A flapper 16 is arranged between the reverse roller group 14 and discharge roller 17. The flapper 16 is driven by a flapper solenoid 143 shown in FIG. 3 to selectively send the documents D back to the carrying unit S or to guide them to the discharge tray 18. The flapper 16 usually guides the documents D to the discharge tray 18.

In FIG. 1, reference numeral 19 denotes an ADF (automatic document feeder) open sensor for detecting whether the document carrying device is opened or closed with respect to the document table 1, 20 indicates a cover open sensor for detecting whether a cover for the supply unit S is opened or closed, and 21 represents a document stopper for positioning the documents D placed on the table 1.

Figure 2:
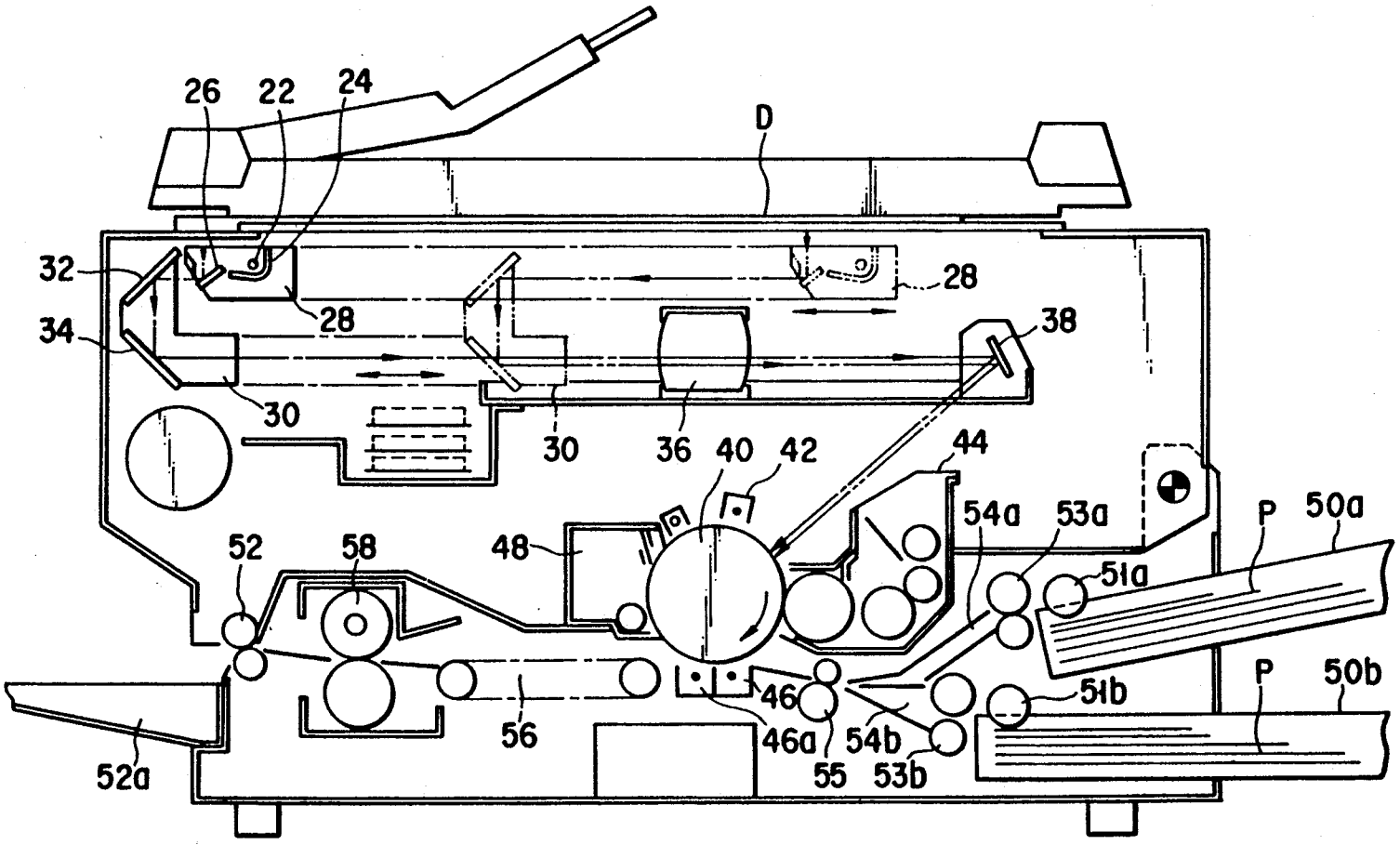
FIG. 2 is a schematic view of an electronic copying machine on which the document carrying device is mounted.

FIG. 2 schematically shows the electronic copying machine on which the automatic document carrying device shown in FIG. 1 is mounted. The electronic copying machine comprises the document table 1 thereon, and the automatic document carrying device is mounted on the table 1.

Under the table 1, the electronic copying machine includes a lamp 22 for illuminating the documents D with light, a reflection plate 24 for focusing the light from the lamp 22 on the documents D, a first mirror 26 for reflecting the light reflected from the documents D toward a second carriage 30, described later, a first carriage 28 which can be moved in parallel to the table 1 by means of a belt with teeth (not shown) and the like driven by a pulse motor (not shown), second and third mirrors 32 and 34, arranged at right angles to each other, for reflecting the light reflected from the documents D toward a photosensitive drum 40, and the second carriage 30 driven pursuant to the first carriage 28 by means of the belt with teeth and moved at a half of the speed of the first carriage 28. Under the first carriage 28 and within the axis of the light reflected by the second and third mirrors 32 and 34, the electronic copying machine includes a lens 36, which can be moved by a drive mechanism (not shown), for giving the focusing property to the reflected light from the second carriage 30 and focusing the reflected light it at a predetermined magnification by its own movement, and a fourth mirror 38, which can be moved along an axis of light by a drive mechanism (not shown), for reflecting the reflected light toward the photosensitive drum 40, focusing it on a predetermined position of the photosensitive drum 40, and correcting a variation in focal distance due to the movement of the lens 36. Needless to say, the reflected light corresponds to characters or drawings on the documents D, that is, image information thereon.

The photosensitive drum 40 on which a charge distribution pattern, i.e., an electrostatic latent image is formed by focusing the light guided by the fourth mirror 38, is arranged under the lens 36 or in the central part of the copying machine. A charging device 42 for adding predetermined electric charges to the photosensitive drum 40, a developing unit 44 for making the electrostatic latent image formed on the photosensitive drum 40 visible by the use of toner, a transfer device 46, which is integrally formed with an AC voltage applying device **46*a* for separating copying paper P from the photosensitive drum 40, for transferring a toner image formed on the photosensitive drum 40 to the copying paper P supplied from a paper supply section, described later, and a cleaning device 48 for eliminating the distributed charges from the photosensitive drum 40 to return the photosensitive drum 40 from the charging state to the initial state and remove the remaining toner from the drum 40, are arranged in sequence around the photosensitive drum 40. Needless to say, since the electrostatic latent image formed on the photosensitive drum 40 is changed to the toner image by the developing unit 44**, the image information of the documents D is copied as the toner image and output onto the paper P.

Paper cassettes **50*a* and 50*b* for supplying the image forming material such as copying paper P, post cards, and OHP (overhead projector) sheets to the photosensitive drum 40, are inserted in the right side of the copying machine in FIG. 2**.

A paper discharge tray **52*a* for stocking the paper P on which the toner image formed on the photosensitive drum 40 is fixed, is arranged in the left of the copying machine in FIG. 2**. Generally, the copying paper P is fed from one end of the copying machine and discharged from the opposite end thereof.

Further, first and second paper feed rollers **51*a* and 51*b* for removing the paper P one by one from the cassettes 50*a* and 50*b*, first and second carrying roller pairs 53*a* and 53*b* for feeding the paper P to the photosensitive drum 40, feed paths 54*a* and 54*b* for feeding the paper P from the carrying roller pairs 53*a* and 53*b* to the photosensitive drum 40, and a pair of timing roller 55 for correcting an inclination of the paper P, conforming the leading edge of the image formed on the photosensitive drum 40 to that of the paper P, and feeding the paper P at the same speed as the rotational speed of the photosensitive drum 40, are arranged between the photosensitive drum 40 and the cassettes 50*a* and 50*b*. In addition, a carrying device 56 for carrying the paper P to which the toner image formed on the photosensitive drum 40 is transferred and toner is electrostatically adhered, a fixing device 58 for fusing and fixing the toner on the paper P, and a pair of discharge rollers 52** for discharging the paper on which the toner is fixed outside the copying machine.

Figure 3:
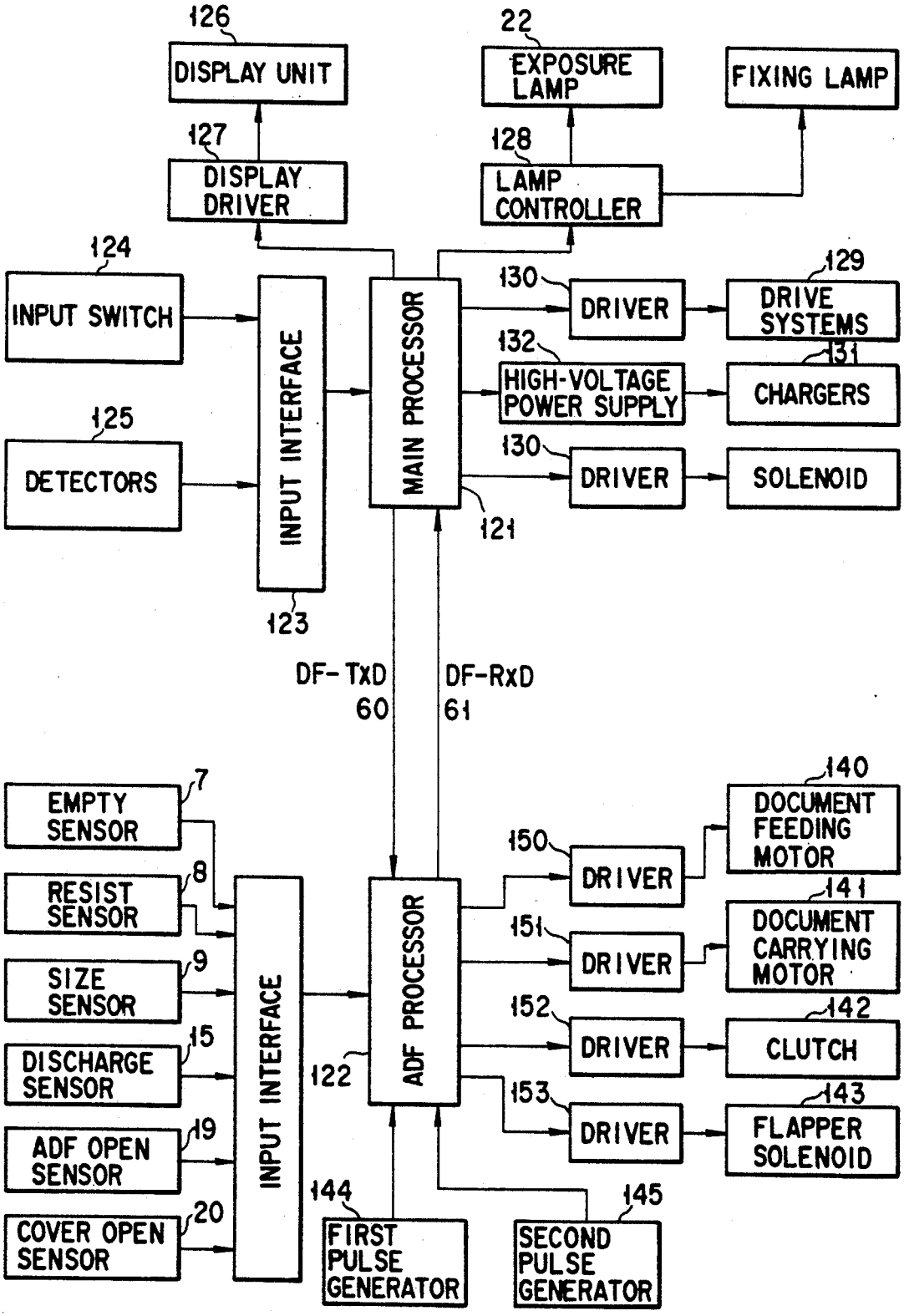
FIG. 3 is a block diagram showing the overall control system of the electronic copying machine and the document carrying device.

FIG. 3 is a block diagram showing the overall control system of the above-described automatic document carrying device and electronic copying machine. In FIG. 3, reference numeral 121 denotes a main processor for mainly controlling the electronic copying machine, and 122 indicates an ADF processor for mainly controlling the automatic document carrying device. Various types of interface signals (described later) are transferred between these processors.

An input switch 124 such as keys on an operation panel, not shown, and various types of detectors 125 such as a switch and a sensor necessary for controlling the other devices, are connected to the main processor 121. Furthermore, a driver 127 for driving a display unit 126 such as displays on the operation panel, a lamp controller for controlling an exposure lamp 22 and the like, a driver 130 for driving various drive systems (main motor, clutch, solenoid, etc.), and a high-voltage power supply 132 for driving various chargers 131, are connected to the main processor 121.

The empty sensor 7, resist sensor 8, size sensor 9, discharge sensor 15, ADF open sensor 19, and cover sensor 20 are connected to the ADF processor 122.

Drivers 150, 151, 152, and 153 for driving a document feeding motor 140 for driving the pick-up roller 3 and separation roller 4, a carrying motor 141 for driving the carrying belt 12 of the carrying unit, aligning roller 6, reverse rollers 14, and discharger roller 17, a clutch 142 for transmitting a drive force from the carrying motor 141 to the aligning roller 6, and a flapper solenoid 143 for driving the flapper 16, respectively, are connected to the ADF processor 122. Furthermore, first and second pulse generators 144 and 145 are also connected to the ADF processor 122. The first pulse generator 144 generates a clock pulse by a rotary encoder attached to the document feeding motor 140, and the second pulse generator 145 generates a clock pulse by a rotary encoder attached to the carrying motor 141.

The interface signals transferred between the main processor 121 and ADF processor 122 will now be described.

The interface signals are transferred between the two processors by an asynchronous serial communication system. The interface signals are transmitted from the main processor 121 to the ADF processor through a control signal group (DF-TxD) 60, and transmitted from the ADF processor 122 to the main processor 121 through a signal group (DF-RxD) 61 representing the state of the ADF processor.

The interface signals transmitted from the main processor 121 to the ADF processor 122 are the following seven signals: a one-side-printed document/ both-side-printed document selection signal (ORG-ROTH) for setting a both-side-printed document carrying mode or a one-side-printed document carrying mode, a document feeding signal (ORG-IN) for starting a document changing operation, a document discharge signal (ORG-OUT) for discharging the document on the carrying path, a mode signal (MODE) for representing that the document carrying device is set in a normal document carrying mode or a test mode, a test code signal (TEST) for transmitting a coded signal when the document carrying device is set in the test mode and performing various test operations, an adjustment code signal (ADJUST) for adjusting an amount of carriage of the document when the document carrying device is set in the normal document carrying mode, and an aging signal (AGING) for operating the document carrying device without carrying any documents at the same timing as when the documents are carried.

The interface signals (represented by the document carrying device) transmitted from the ADF processor 122 to the main processor 121 are the following ten signals: a document setting signal (ORG-RDY) representing whether the documents D are set in the document feeding tray 2, a jam signal (DF-JAM) indicative of a jam, an error signal (DF-ERR) indicating that an operation error occurs in the paper feeding motor 40 or carrying motor 41 of the document carrying device, an error code signal (ERR-COD) for coding the content represented by the error signal (DF-ERR) or jam signal (DF-JAM) and supplying the coded content to the copying machine, a DF operating signal (DF-ACT) which is output from the beginning of the document changing operation of the document carrying device to the end of the document size detection thereof, a document stop signal (ORG-STP) indicating that the documents are set in the exposure position, a DF open signal (DF-OPN) representative of the opening/closing state of the cover for the carrying unit or document feeding unit of the document carrying device, a document size signal (SIZE 0, SIZE 1, SIZE 2, SIZE 3) for representing the sizes of the documents by a 4-bit code, a document face/back signal (ORG-FACE) indicating whether the first or second surface of a document is set downward in the exposure position in the both-side-printed document carrying mode, and a forward-feeding signal (PRE-FED) representing that the documents are at the forward-feeding or not.

When the main processor 121 receives the jam signal (DF-JAM) from the ADF processor 122, it performs a predetermined control in response to the error code signal (ERR-COD) from the ADF processor 122. For example, when a document other than a document subjected to exposure (image formation) is jammed (e.g., feeding jam at the forward-feeding position, discharge jam on the discharge roller), a copying operation is not intermitted but continues until a preset number of copies are completed. When a document is jammed during its exposure, the copying operation is stopped immediately. After the jam is released, the document feeding signal (ORG-IN) and document discharge signal (ORG-OUT) are transmitted from the main processor 121 to the ADF processor 122 while the documents are being fed.

Figure 4:
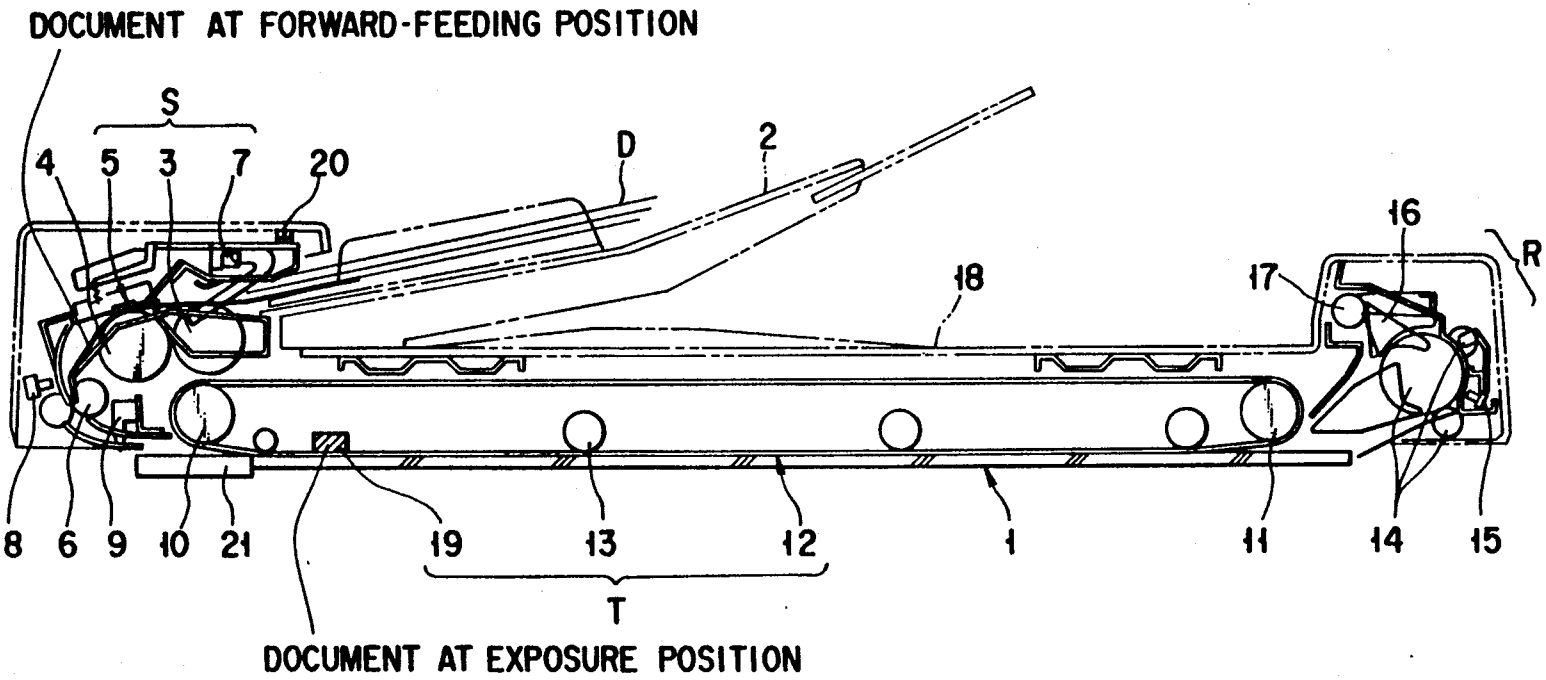
FIG. 4 is a view for explaining an operation of the document carrying device.
Figure 5:
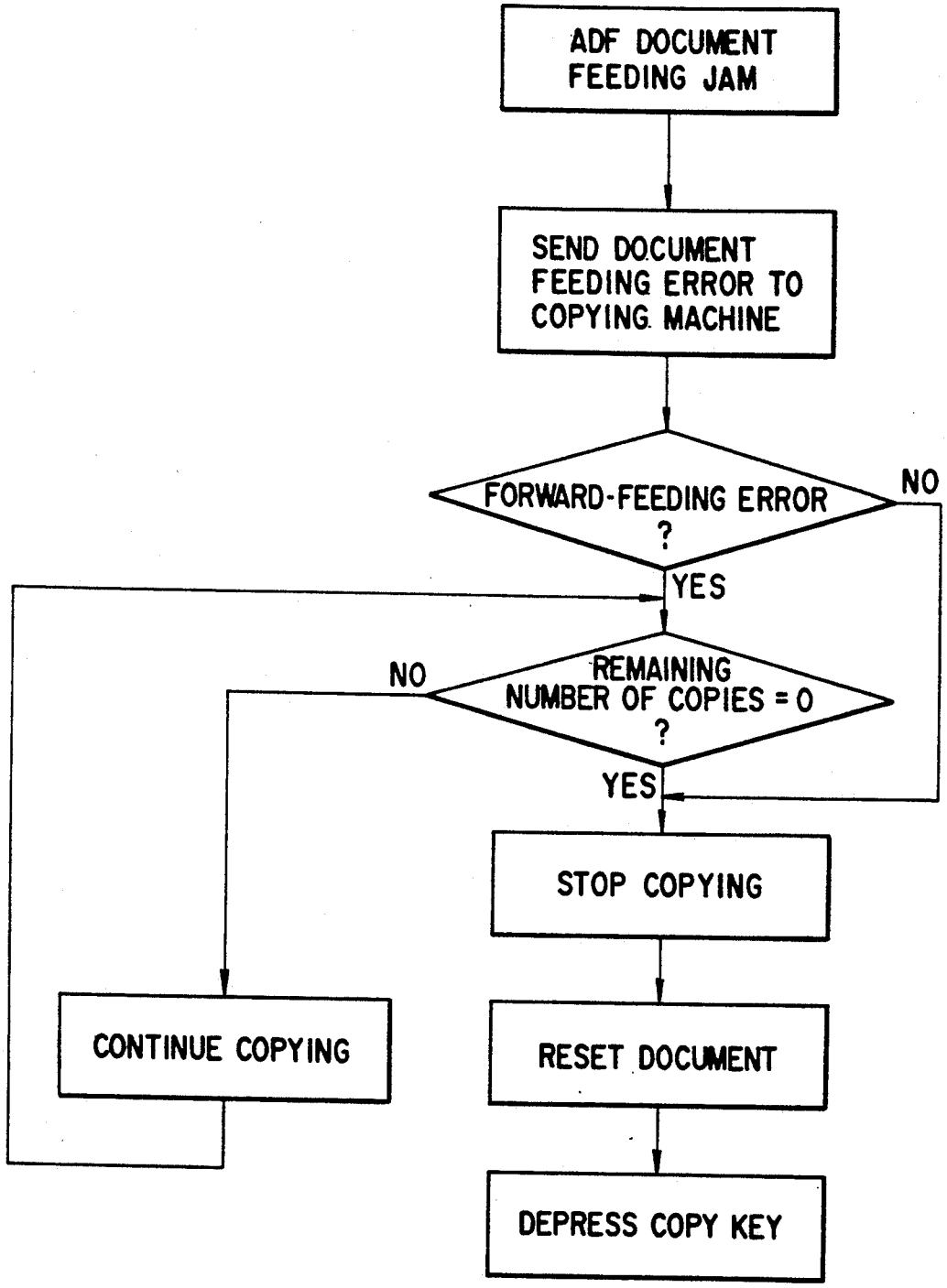
FIG. 5 is a flowchart showing a copying operation performed when a document feeding jam occurs.

An operation of the document carrying device, which is performed when the one-side-printed document is carried, will be described. FIG. 4 shows an operation of the document carrying device, and FIG. 5 shows a flowchart for explaining the copying operation performed when the document feeding jam occurs.

When predetermined time elapses after a power switch (not shown) is turned on, the copying machine is set in a ready state (capable of copying). The main processor 121 can receive a signal input by a copy key on the operation panel to allow the interface signals to be transferred between the main processor 121 and ADF processor 122.

If the documents D are set in the document feeding tray 2 in this state, the empty sensor 7 is turned on to detect the presence of the documents. The ADF processor 122 thus supplies the document setting signal (ORG-RDY) to the main processor 121. When the copy key is depressed, the main processor 121 outputs the document feeding signal (ORG-IN).

When the ADF processor 122 receives the document feeding signal (ORG-IN), the DF operating signal (DF-ACT) is rendered conductive, and the document stop signal (ORG-STP) is rendered nonconductive, thereby starting a document carrying operation of the document carrying device. More specifically, the document feeding motor 140 is turned on to drive the pick-up roller 3 and separation roller 4 and carry the first lowest one of the documents D set in the document feeding tray 2 to the aligning roller 6. When a predetermined time elapses after the resist sensor 8 senses the leading edge of the document D carried to the roller 6, the document feeding motor 140 is stopped to align the document D by the aligning roller 6. The carrying motor 141 is then rotated forward, and the carrying belt 12, reverse rollers 14, and discharge roller 17 are rotated in the discharge direction, thereby discharging a document remaining on the table 1 Upon completing the discharge operation of the remaining document, the clutch 142 is turned on to send the document D, which has been carried to the aligning roller 6, to the carrying belt 12.

When the document D passes the size sensor 9 to detect its width in a direction perpendicular to the document carrying direction, then the trailing edge thereof passes the resist sensor 8, the document size signal (SIZE 0 to 3) is set and the DF operating signal (DF-ACT) is rendered nonconductive. The pulses generated from the first pulse generator 144 are counted at this time to calculate an amount of carriage of the document D. If the amount of carriage is calculated when the trailing edge of the document D exceeds the left edge of the document stopper 21 by a predetermined amount, the carrying motor 141 is stopped and, after a lapse of predetermined time, it is rotated reversely, with the result that the document D is hit against the left edge of the document stopper 21 and the carrying operation of the document D is completed. The document stop signal (ORG-STP) is supplied to the main processor predetermined time before the completion of the carrying operation. Therefore, the document scanning system (first carriage 28) of the copying machine starts in response to the document stop signal (ORG-STP), and time required from the starting of the document scanning system to the document scanning thereof, is shortened.

Upon completion of carriage of the first document D, the document scanning system (first carriage 28) scans the document D. While the document D is being scanned, the document carrying device carries the second document D to the aligning roller 6 by the same control as that of the document carrying operation of the first document D and sets the second document D in a standby state at the forward-feeding position nearer to the exposure position (the image reading position).

When the reading of the first document D is completed, the document feeding signal (ORG-IN) is supplied from the main processor 121 to the ADF processor 122. When the ADF processor 122 receives the document feeding signal (ORG-IN), the carrying operation of the second document D is started from the forward-feeding position. If the length of the first document D is smaller than a predetermined length in its carrying direction, a step carrying operation is performed. The step carrying operation means that, when, the document D at the exposure position is exchange for the next document D, the former document D is not discharged into the discharge tray 18 but carried to the discharge sensor 15 between the exposure position and the discharge tray 18 in such a manner that its leading edge reaches a step position (intermediate position) of the discharge sensor 15, and stands by therein. If the appearance of the document is not taken into consideration, the step carrying operation can be performed, irrespective of the size of the document. The step carrying operation allows a document to start moving to the exposure position when another document at the exposure position reaches the step position before a position at which the latter document can be discharged into the discharge tray 18; therefore, the time required for exchanging these documents can be reduced.

If an amount of carriage of the second document D is obtained when its trailing edge exceeds the left edge of the document stopper by a predetermined amount, the carrying motor 141 is stopped and, after a lapse of predetermined time, it is rotated reversely, with the result that the second document D hits the left edge of the document stopper 21 and its carrying operation is completed. Then the third document D is carried to the forward-feeding position.

Upon scanning of the second document D, the third document D starts to move from the forward-feeding position. If the length of the second document D is smaller than a predetermined length, the step feeding operation is performed. At the same time, the first document D is discharged from the step position to the discharge tray 18.

As described above, the process of carrying the documents is repeated.

When the length of the first document D is greater than the predetermined length in its feeding direction, the step feeding operation is not performed. The clutch 142 is turned on when the first document D moved from the exposure position to the position where it can be discharged into the discharge tray 18, and the aligning roller 6 is driven to feed the second document D which stands by in the forward-feeding position.

When the step feeding operation is not performed, a plurality of documents is repeatedly fed.

When the step feeding operation is not performed, the first document D, which has been exposed, is discharged into the discharge tray 18 at the same time that the second document D is fed to the exposure position.

In the discharge operation, when the document D at the step position to perform the step carrying operation or at the exposure position not to perform the step carrying operation, is moved by a predetermined distance, the rotational speed of the carrying motor 141 is decreased, with the result that the document D is aligned on the discharge tray 18. This distance depends on the size of the document D, the distance between the exposure position and the discharge roller 17, etc.

If all the documents A are fed from the document feeding tray 2, the empty sensor 7 is turned off, and the ADF processor 122 shuts off the document set signal (ORG-RDY). When the main processor 121 detects that the document set signal is shut off, it outputs the document discharge signal (ORG-OUT) to discharge the document D onto the discharge tray 18. When the ADF processor 122 receives the document discharge signal (ORG-OUT), if the step carrying operation is being performed, both the document at the step position and the final document at the exposure position are discharged. This discharge is controlled as follows. When the document D, at the step position to perform the step carrying operation or at the exposure position not to perform the step carrying operation, is moved by a predetermined distance which depends on the size of the document D, the distance between the exposure position and the discharger roller 17, etc., the rotational speed of the carrying motor 141 is decreased; thus the carrying speeds of the documents D at the step and exposure positions are decreased, with the result that the documents D are discharged into the discharge tray 18 at the decreased carrying speed and aligned therein. The carrying speed of the final document at the exposure position is decreased at the same time when that of the document at the step position is decreased. More specifically, all the documents except the final document are reduced in speed after they are carried from the step position by a predetermined distance, but the final document is reduced to the same carrying speed as that of the preceding document.

The carrying motor 141 is stopped after a lapse of predetermined time after the trailing edge of the document D at the exposure position passes the discharge sensor 15. The document discharge operation, which is performed in response to the document discharge signal (ORG-OUT) when no documents are exchanged in the step carrying operation, is to carry one document from the exposure position to the discharge tray 18 and is executed under the same control as that of the document discharge operation performed when the documents are exchanged except in the step carrying operation. The operation of carrying one-side-printed documents is thus completed.

Next, an operation of carrying both-side-printed documents will be described.

An operation of carrying the first document D from the document feeding tray 2 to the aligning roller 6 is the same as that in the one-side-printed document carrying operation. When the leading edge of the document D reaches the aligning roller 6, the carrying motor 41 is rotated forward, and the carrying belt 12, reverse rollers 14, and discharge roller 17 are rotated in the document feeding direction in order to discharge the document D. In this case, a document may remain on the document table 1.

If the document remaining on the table is discharged, the clutch 142 is turned on to send the document D stopped at the aligning roller to the carrying belt 12.

When the document D passes the size sensor 9 to detect its width in a direction perpendicular to the document carrying direction and the trailing edge thereof passes the resist sensor 8, the document size signal (SIZE 0 to 3) is set. After a lapse of predetermined time after the trailing edge of the document D passes the resist sensor 8, the clutch 142 is turned off and the flapper solenoid 143 is turned on to set the flapper 16 in a direction in which the document D is rotated reversely. The document D is moved on the document table 1 by the carrying belt 12 and, after a lapse of predetermined time after the leading edge of the document D passes the discharge sensor 15, that is, when the leading edge of the document D reaches between a reverse document discharge unit and belt roller 11, the carrying motor is stopped to reverse its rotating direction. After a lapse of predetermined time after the carrying motor 141 is stopped, the carrying motor starts to rotate reversely to carry the document D to the document stopper 160. The ADF processor 122 cuts off the DF operating signal (DF-ACT) predetermined time before the trailing edge of the document D reaches the document stopper 160 and, when the leading edge of the document D arrives at the document stopper 160, the document stop signal (ORG-STP) is set and the carrying motor 141 is stopped. The amount of carriage of the document D is determined by counting pulses generated from the first pulse generator 144 after the leading edge of the document D passes the discharge sensor 15.

Upon outputting the document stop signal (ORG-STP), the electronic copying machine starts an operation of scanning the document by the document scanning system. The main processor 121 outputs the document feeding signal (ORG-IN) to reverse the document D. Upon receiving the document feeding signal (ORG-IN), the ADF processor 122 rotates the carrying motor 141 forward to move the document D from the exposure position to the reverse document discharge unit. The document D is reversed by the reverse document discharge unit, and the reversed document is carried to the exposure position. While the reversed document is being scanned, the second document D is carried to the forward-feeding position. If the main processor 121 outputs the next document feeding signal (ORG-IN), the document carrying device carries the second document D.

An operation of the document carrying device which is performed when an error in document feeding occurs, will now be described.

During the above-described document carrying operations and copying operations, the empty sensor 7 detects whether a document is set in a feeding state or not, and the resist sensor 8 detects whether the document is carried to the forward-feeding position or not. When the resist sensor 8 senses an error in document feeding at the forward-feeding position, the ADF processor 122 transmits the jam signal (DF-JAM) and error code signal (ERR-COD) to the main processor 121. The main processor 121 determines the error in document feeding and continues copying a document on the table 1 until a preset number of copies for the document are completed. If the jammed document is reset, the empty sensor 7 senses it, and a sense signal is transmitted from the ADF processor 122 to the main processor 121. The main processor 121 executes a predetermined display of JAM after the preset number of copies are completed. When the main processor 121 determines that the jammed document is reset and the jam is released, it sends the document discharge signal (ORG-OUT) to the ADF processor 122 to discharge the document on the document carrying path, and transmits the document feeding signal (ORG-IN) to the ADF processor 122 to start exchanging the documents. The copying operation can thus be restarted by depressing the input switch 124.

Except when the malfunction (jam) in document feeding occurs at the forward-feeding position, for example, when a malfunction in document carriage, which does not affect image formation of the document at the image reading position, occurs, or when a document other than the document at the exposure position (image reading position) is jammed (when a discharge jam occurs), the discharge sensor 15 senses the discharge jam and then the main processor 121 continues copying the original at the image reading position on the document table 1 until the preset number of copies are completed. If the discharge jam is released, the document exchange operation is started and the copying operation is restarted, as in the case where the jam in document feeding occurs at the forward-feeding position.

When a document is jammed at the exposure position (image reading position), the copying operation is stopped immediately, as in the conventional case.

As described above, in the image forming apparatus according to the present invention, the copying machine can continue its copying operation for a document until a preset number of copies are completed, even when a jam in document feeding occurs at the forward-feeding position. Therefore, a correct number of copies can be obtained irrespective of a method of processing the error in document feeding or document discharge, and a complicated control is not required.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An image forming apparatus for producing a plurality of copies from a single original, the apparatus having an image reading position where images of the original are read and an upstream position located upstream of the image reading position, said apparatus comprising:

means for carrying originals in succession, said carrying means carrying a first original to the image reading position and, at the same time, carrying a second original to the upstream position;

means for detecting a carrying malfunction regarding the second original which is carried to the upstream position by the carrying means;

means for forming images in succession, said forming means forming an image of the first original on image forming media, and forming an image of the second original on image forming media after completion of the image forming operation of the first original; and means, operating when the detecting means detects the malfunction, for preventing the forming means from starting the image forming operation of the second original after completion of the image forming operation of the first original.

2. The image forming apparatus of claim 1 in which the means for forming images is immediately stopped if the original is jammed at the exposure position.

3. The apparatus according to claim 1, wherein said control means includes means for detecting that the carrying malfunction in the document carried to the image reading position is released, and means for instructing said carrying means to discharge the document from the image reading position when the image is formed on all the preset number of image forming mediums in accordance with a release of the carrying malfunction.

4. The apparatus according to claim 1, further comprising means for displaying the carrying malfunction in the document after said control means stops said forming means from forming the image.

5. The apparatus according to claim 1, wherein said carrying means includes means for feeding the document to the image reading position, means for sending the document from the image reading position, and means for selectively performing an operation of reversing the document sent by said sending means and returning the document to the image reading position and an operation of discharging the document.

6. The apparatus according to claim 1, wherein said control means comprises first and second control means, said first control means including:

means for transmitting a carrying malfunction detection signal to said second control means;

means for transmitting a carrying malfunction release signal to said second control means when the carrying malfunction in the document is released; and means for instructing said carrying means to discharge the document from the image reading position in response to a document discharge signal from said second control means and to carry a next document to the image reading position, and said second control means including:

means for determining the carrying malfunction in the document in response to the carrying malfunction detection signal from said control means;

means for instructing said apparatus to continue copying the document at the image reading position until the image is formed on all the preset number of image forming mediums; and means for transmitting the document discharge signal to said first control means when the image is formed on all the preset number of image forming mediums in response to the carrying malfunction release signal from said first control means.

7. An automatic document carrying device for carrying a document to an image reading position to read an image of the document, comprising:

means for carrying the document to the image reading position, said carrying means including means for feeding the document, means for carrying the document to an intermediate position between the document feeding means and image reading position, and means for carrying the document from the intermediate position to the image reading position;

means for discharge the document from the image reading position after the image of the document is read;

means for detecting a carrying malfunction in the document carried by said carrying means, said detecting means including means for detecting a carrying malfunction in the document carried from said document feeding means to the intermediate position; and means for instructing said discharging means to discharge the document from the image reading position after the image of the document at the image reading position is read when said detecting means detects a carrying malfunction in the document carried from said document feeding means to the intermediate position.

8. The automatic document carrying device of claim 3, wherein a succession of documents having images thereon to be read are, during normal operation of the device, carried first to the intermediate position and subsequently to the image reading position.

9. The device according to claim 7, wherein said control means includes means for detecting that the carrying malfunction error in the document carried to the image reading position is released, and means for instructing said discharging means to discharge the document when the image has been read in accordance with a release of the carrying malfunction.

10. The device according to claim 7, further comprising means for displaying the carrying malfunction in the document after the image has been read.

11. The device according to claim 7, wherein said carrying means includes means for feeding the document to the image reading position, means for sending the document from the image reading position and said discharging means includes means for selectively performing an operation of reversing the document sent by said sending means and returning the document to the image reading position and an operation of discharging the document.

* * * * *